US005927768A

United States Patent [19]

Dallmann et al.

[11] Patent Number: 5,927,768

[45] Date of Patent: Jul. 27, 1999

[54] NON-HANDED WINDOW LOCK ACTUATOR

[75] Inventors: Brian D. Dallmann; Timothy T. Frenzen; Thomas J. Midas, all of Owatonna, Minn.

[73] Assignee: Truth Hardware Corporation, Owatonna, Minn.

[21] Appl. No.: 09/076,294

[22] Filed: May 11, 1998

[51] Int. Cl.[6] ..... E05C 1/06

[52] U.S. Cl. ..... 292/158; 292/139; 292/336.3

[58] Field of Search ..... 292/137, 158, 292/161, 156, 138, 139, 143, 193, DIG. 33, 336.3; 403/348, 353

[56] References Cited

U.S. PATENT DOCUMENTS 4,991,886 2/1991 Nolte et al. .
5,118,145 6/1992 Tucker .
5,829,802 11/1998 Anderson et al. ..... 292/333.6

*Primary Examiner*—Steven Meyers
*Assistant Examiner*—Teri Pham
*Attorney, Agent, or Firm*—Wood, Phillips, VanSanten, Clark & Mortimer

[57] ABSTRACT

A non-handed actuator for window locks, including a base securable to the window frame, a handle secured to the base for pivoting about a first axis through an angle of approximately X degrees, an oppositely extending drive link secured for pivoting with the handle, and a connecting link securable to the lock control member of a window lock. The connecting link is pivotable relative to the drive link and includes a spacing member and a connecting member. The connecting member is securable to the lock control member and pivotable relative to the spacing member between limit positions approximately 180 degrees apart. Tabs on the spacing member abut the connecting member when the connecting member is at either of the limit positions, with the connecting link being pivotable relative to the drive link through an angle of approximately 2X degrees, where X is between 140 and 180.

22 Claims, 3 Drawing Sheets

NON-HANDED WINDOW LOCK ACTUATOR

BACKGROUND OF THE INVENTION

1. Technical Field

The present invention is directed toward window locks, and more particularly toward manually operable actuators for window locks.

2. Backgroung Art

Window locks are known in the art generally having a catch with a handle actuator affixed to a window frame which interacts with a keeper on a corresponding section of a movable window sash to securely hold the sash tightly against the frame. Also known in the art are devices for sequential multi-point lock-up of the movable window sash with the window frame.

These latter devices are locks which have a handle actuator interacting with a keeper at one point on a window frame and sash respectively which causes a second lock to engage a keeper at a distant location.

Commonly owned Nolte et al. U.S. Pat. No. 4,991,886 and Tucker U.S. Pat. No. 5,118,145, hereby fully incorporated by reference, disclose such multi-point locks for a window sash. These devices use a tie bar connecting two spaced apart cam members or rollers which can interact with keepers affixed to a window sash to establish a locked condition of the window. The movement of a handle actuator from its unlocked position causes the adjacent roller on the tie bar to connect with a planar portion of an associated ramped keeper. Continued movement of the handle actuator causes the tie bar to also move the second roller onto the planar section of the second associated ramped keeper.

Because locks such as the above are used in many different windows having window frames and window sashes with a variety of dimensions and configurations, the spacing of the handle actuator from the tie bar axis can vary between installations. This can result in such locks either being usable with only one style window, or alternatively can undesirably require that different locks be manufactured for each different possible window. The later alternative not only significantly increases manufacturing costs, but it also requires builders to maintain undesirably large inventories of such locks. Further, such large inventories of different locks can result in serious and costly construction delays if the wrong locks are delivered to a particular installation.

U.S. Pat. No. 5,118,145 discloses a structure which allows for a single handle actuator to be used with a variety of different spacings from the bar axis. However, while that structure can be used with a variety of different installations to reduce inventory requirements and construction delays, it still requires that different handle actuators be provided for right and left hand installations. That is, typically it is desired that the handle be pivoted down to lock and up to unlock. It is further typically desired that the handle portion be on the side of the actuator housing which is adjacent the window opening (i.e., away from the frame). Such configurations ensure that the handle actuator is conventionally operable, and further is clear from inwardly projecting sections of the window frame which might interfere with the ability of a person operating the handle actuator to properly grasp the handle without scratching their knuckles. Therefore, while the invention disclosed in U.S. Pat. No. 5,118,145 allows for a significant reduction in inventory requirements and construction delays, it does still require that at least two such handle actuators be available, one for right hand installations and one for left hand installations.

The present invention is directed toward overcoming one or more of the problems set forth above.

SUMMARY OF THE INVENTION

In one aspect of the present invention, a non-handed actuator for window locks is provided, including a base securable to the window frame, a handle secured to the base for pivoting about a first axis through an angle of approximately X degrees, an oppositely extending drive link secured for pivoting with the handle, and a connecting link securable to the lock control member of a window lock. The connecting link is pivotable relative to the drive link and includes a spacing member and a connecting member. The connecting member is securable to the lock control member and pivotable relative to the spacing member between limit positions approximately 180 degrees apart.

In a preferred form of this aspect of the present invention, a first tab is provided on one of the spacing member and connecting member and a second tab is provided on one of the spacing member and connecting member, with the first tab abutting one side of the other of the spacing member and the connecting member when the connecting member is at one of the limit positions and the second tab abutting the other side of the other of the spacing member and connecting member when the connecting member is at the other of the limit positions.

In another preferred form, the spacing member substantially lies in a first plane, the connecting member includes a portion lying in a second plane substantially parallel to and spaced from the first plane, and the tabs lie in both the first plane and the second plane.

In another aspect of the present invention, a non-handed actuator is provided including a handle secured to the base for pivoting through an angle of approximately X degrees, an oppositely extending drive link secured for pivoting with the handle, a connecting link securable to the lock control member of a window lock and pivotable relative to the drive link, and stops limiting the relative pivoting of the connecting link relative to the drive link to an angle of approximately 2X degrees.

In a preferred form of this aspect of the present invention, the connecting link comprises a first connecting link member pivotally connected to the drive link and the second connecting link member pivotally connected to the first connecting link member. The stops comprise tabs on opposite sides of the first connecting link member limiting pivoting of the drive link relative to the first connecting link member and of the first connecting link member relative to the second connecting link member by abutting the drive link at each limit of relative pivoting of the drive link to the first connecting link member and abutting the second connecting link member at each limit of relative pivoting of the first connecting link member to the second connecting link member.

In another preferred form, the stops limit relative pivoting of the links whereby the second connecting link may pivot up to about 360 degrees relative to the drive link. In a highly preferred form, X is between 140 and 180.

In another aspect of the present invention, a non-handed actuator is provided including a base, handle and drive link, and further including a first connecting link secured to the drive link for pivoting about a second axis spaced from the first axis, a second connecting link secured to the first connecting link for pivoting about a third axis spaced from the second axis and securable to the lock control member of a window lock, and stops limiting the pivoting of the drive link relative to the first connecting link and of the first connecting link relative to the second connecting link.

In a preferred form of this aspect of the present invention, the stops comprise tabs on opposite sides of the first connecting link, at least one tab abutting the drive link at each limit of relative pivoting of the drive link to the first connecting link and at least one tab abutting the second connecting link at each limit of relative pivoting of the first connecting link to the second connecting link.

In another preferred form, the first connecting link substantially lies in a first plane normal to the second and third axes and the second connecting link and drive link each include portions lying in a second plane substantially parallel to and spaced from the first plane, and the stops comprise tabs on the first connecting link extending from the first plane to the second plane.

In another preferred form, the drive link and first and second connecting links extend longitudinally in a generally radial direction relative to the pivot axes with a transverse width, one of the stops being longitudinally spaced from the second axis generally one half of the drive link transverse width and/or are longitudinally spaced from the third axis generally one half of the second connecting link transverse width.

In still another preferred form, the stops limit relative pivoting of the links whereby the second connecting link may pivot up to about 360 degrees relative to the drive link. In still further preferred forms, the stops limit relative pivoting of the links whereby the second connecting link may pivot between opposite limit positions which are generally parallel to the drive link. In yet further preferred forms, the stops limit pivoting of the second connecting link relative to the drive link to an angle of 2X degrees, where X is between 140 and 180 and, in a highly preferred form, the handle is pivotable through an angle of approximately X degrees relative to the base.

In still another aspect of the present invention, a non-handed actuator for window locks is provided including a housing securable to the window frame with an interior side facing toward the window frame, a handle secured to the housing for pivoting about a first axis, an oppositely extending, generally flat drive link secured for pivoting with the handle generally on the housing interior side, a generally flat first connecting link secured to the drive link for pivoting about a second axis spaced from the first axis, and a generally flat second connecting link secured to the first connecting link for pivoting about a third axis spaced from the second axis and securable to the actuating member of a window lock. First stop tabs extend axially from the first connecting link and engage the drive link at a selected limit of pivoting of the drive link relative to the first connecting link. Second stop tabs extend axially from the first connecting link and engage the second connecting link at a selected limit of pivoting of the second connecting link relative to the first connecting link.

In a preferred form of this aspect of the present invention, the first and second stop tabs are unitary tabs formed from flanges on opposite sides of the first connecting link and bent at generally right angles to the flat first connecting link.

In another preferred form, the first connecting link substantially lies in a first plane normal to the second and third axes and the second connecting link and drive link each include portions lying in a second plane substantially parallel to and spaced from the first plane, and the stops comprise tabs on the first connecting link extending from the first plane to the second plane.

In still another preferred form, the drive link and first and second connecting links extend longitudinally in a generally radial direction relative to the pivot axes with a transverse width. One of the stops is longitudinally spaced from the second axis generally one half of the drive link transverse width and/or another of the stops is longitudinally spaced from the third axis generally one half of the second connecting link transverse width.

It is an object of the invention to provide a multi-point locking structure which provides secure and reliable operation without binding.

It is a further object of the invention to provide a locking structure which may be used in both left and right hand configurations in many different windows having window frames and window sashes with a variety of dimensions and configurations without requiring that different parts be manufactured, inventoried, and delivered to such different window designs. Related objects of the present invention are, therefore, to provide a multi-point locking structure which can be inexpensively manufactured, and which can be easily and inexpensively inventories and handled by the lock installers.

DESCRIPTION OF THE PREFERRED EMBODIMENT

Figure 1:
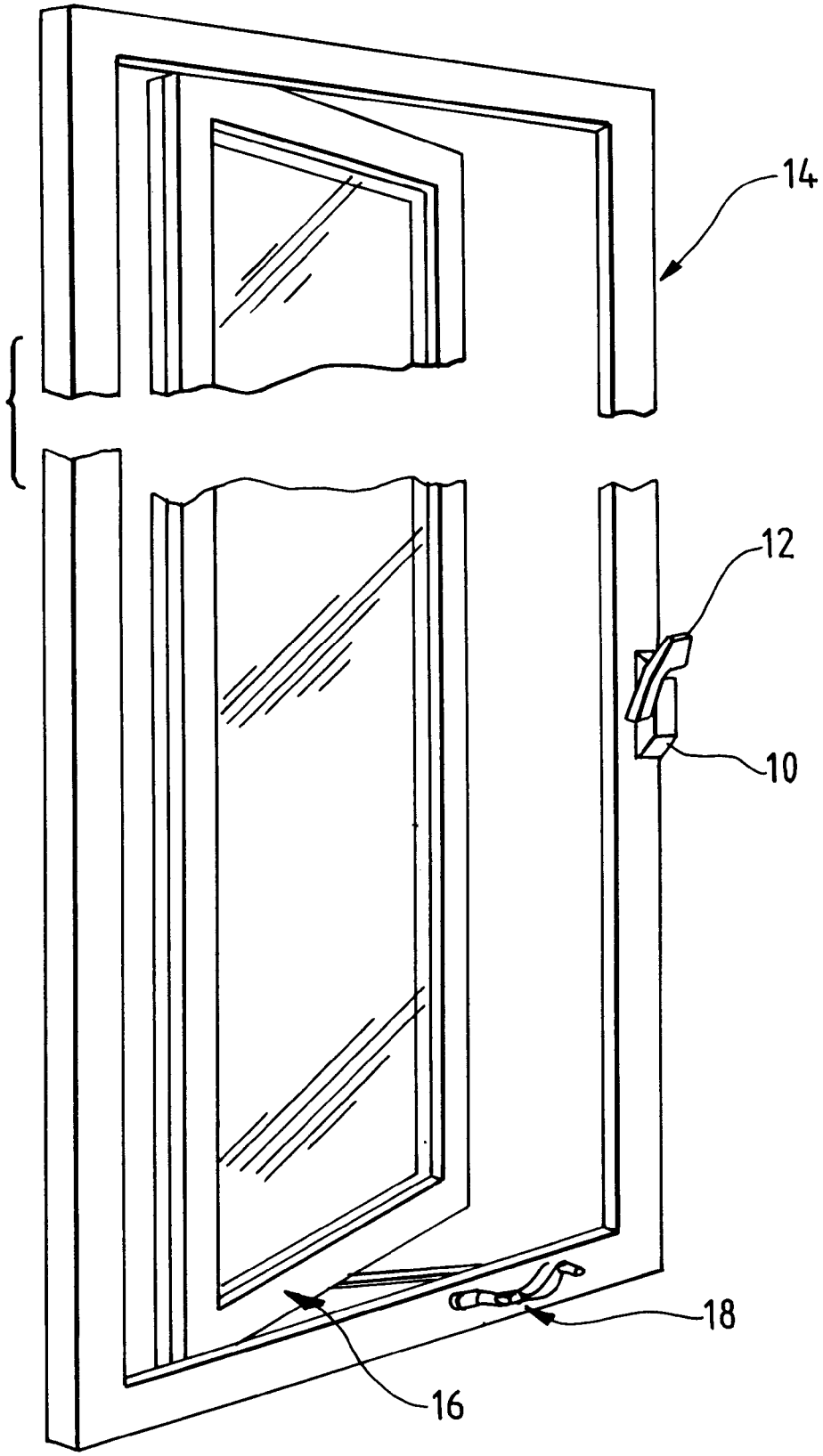
FIG. 1 is a fragmentary, perspective view of a window shown in open position ancwhich has the window lock structure of FIGS. 2–4 associated therewith.

The window lock is shown in association with a window in FIG. 1 and with the only room-visible part thereof being a housing or base 10 and the handle 12 embodying the actuator of the present invention.

The window has a window frame, indicated generally at 14, in which the window sash, generally indicated at 16, of a casement window is pivotally mounted. The mounting of such a window by hinges is well known in the art as well as use of a window operator, indicated generally at 18, for moving the window sash between closed and fully open positions or any desired position therebetween.

As will be readily recognized, the window lock can also be used for an awning-type window wherein the pivotal movement of the window sash would be generally about a horizontal axis, rather than the vertical axis of the casement window. The concepts embodied in the window lock could be utilized with other types of movable windows as well, such as a double hung window.

Figure 2:
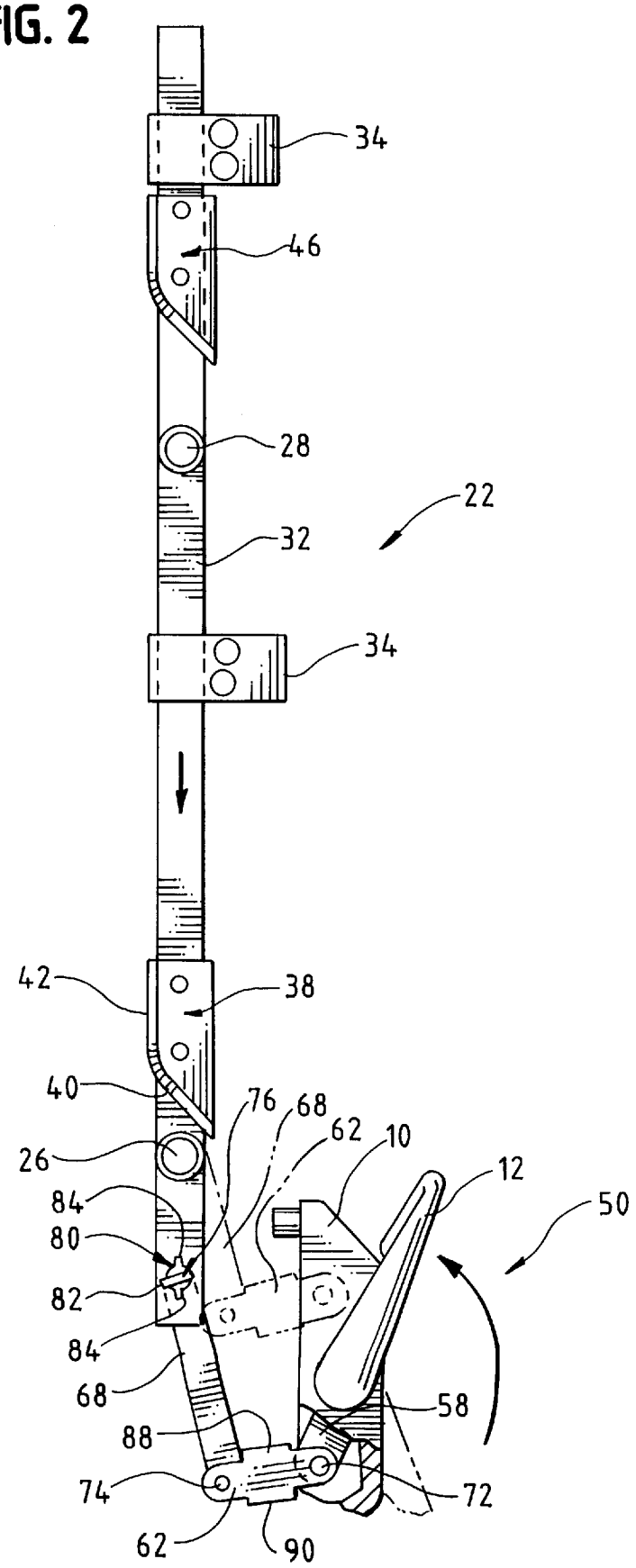
FIG. 2 is a side, partial view of the operational components of a multi-point window lock embodying the present invention, said lock being shown in the released, unlocked position.

In the locking structure 22 shown in FIG. 2 (and as in the prior art such as shown in U.S. Pat. Nos. 4,991,886 and 5,118,145), one or more cam members, such as rollers 26, 28, are secured to a tie bar 32 which is itself suitably secured to the frame 14 by guides 34 which guide the tie bar or lock control member 32 in lengthwise movement along its axis.

The housing 10 rotatably mounts the handle 12 for movement between generally two positions. One of these positions is the window locked position (shown in phantom in FIG. 2), wherein the handle 12 extends downwardly. Counterclockwise pivoting (from the FIG. 2 perspective) of the handle 12 moves the locking structure 22 to its other position, which is the window unlocked (or released) position. In a preferred embodiment, the handle 12 is substantially vertically oriented in the window locked position with the handle 12 being pivotable between about 140 and 180 degrees between the limits of travel from one position to the other. As described in greater detail hereafter, pivoting of the handle 12 controls operation of the locking structure 22 by controlling the vertical position of the tie bar 32.

Specifically, operation of the locking structure 22 involves coaction of at least one roller 26 with a ramped keeper 38 which is mounted by suitable means on the window sash 16 as is known in the art. The ramped keeper 38 has an inclined ramp section 40 and a generally planar section 42. The ramped keeper 38 is shown in FIG. 2 in relation to the roller 26 when the window sash 16 is generally closed but, with the roller 26 clear of the keeper 38, not locked to the window frame 14.

With clockwise rotation of the handle 12 from the FIG. 2 position, the tie bar 32 is moved up, whereby the roller 26 engages first the inclined ramp section 40 and, camming against the keeper 38 as it continues to move up, draws the sash 16 tightly against the window frame 14 until it reaches the planar section 42, at which point the roller 26 and keeper 38 overlap to securely lock the window sash 16 against the frame 14. Of course, reverse motion of the handle 12 would then successively move the roller 26 over the planar section 42 and ramp section 40 until the roller 26 and keeper 38 are once again in the FIG. 2 position allowing the sash 16 to be opened.

As shown in the prior art incorporated by reference herein, the second roller 28 may be mounted to coact with a second ramped keeper 46 to achieve multi-point locking. The second ramped keeper 46 preferably has substantially the same construction as the ramped keeper 38 and therefore coacts with its roller 28 in a similar manner to that discussed above.

Delayed multi-point locking is achieved with the illustrated structure, with lock-up of the second roller 28 and ramped keeper 46 delayed relative to lock-up of the first roller 26 and ramped keeper 38. That is, as shown in the prior art patents incorporated herein by reference, the ramped keepers 38, 46 are spaced a distance apart which is greater than the distance between the rollers 26, 28. With this configuration, the first roller 26 engages the ramp section 40 of its keeper 38 first, with continued movement of the tie bar 32 and rollers 26, 28 first causing the roller 26 to cooperate with the ramp section 40 its keeper 38 to draw the sash 16 closer to the frame 1 4. As movement of the tie bar 32 and rollers 26, 28 continues, eventually the second roller 28 reaches the ramp section of its keeper 46 to similarly begin to draw the sash 16 closer to the frame 14 at that point. (The planar section 42 of ramped keeper 38 has a length greater than the differences in the distances to provide a dwell for one roller 26 while the other roller 28 is on the ramp section of its associated keeper 46). Once both rollers 26 reach the planar section of their respective keepers 38, 46, they coact with one another to hold the sash 16 locked against the frame 14.

It should be understood that the above described locking structure, which is known in the art, is only one of many with which the actuator of the present invention could be used. For example, the actuator of the present invention could be used with structures having more than two sets of coacting rollers and keepers (as might be desirable, for example, with large windows), or could be used with structures having only a single locking point. Still further, any number of coacting keepers and cam structures could be used, including structures in which the keepers are controlled by the handle 12 and the rollers or cams secured to the sash 16. Still further, the actuator of the present invention may be used with a wide variety of different window configurations, including different window frame and window sash configurations.

Reference will now specifically be made to a preferred embodiment of the actuator 50 of the present invention.

The handle 12 is pivotally secured to the housing 10 about a first axis 52 in any suitable manner. The handle 12 includes a pivot shaft 54 extending through a side of the housing 10 to assist in so securing the handle 12, and on its inner end (on the interior side of the housing 10) is suitably secured to a drive link 58 so that the handle 12 and drive link 58 will pivot together. As one example, the drive link 58 and pivot shaft 54 could have a spline connection with, for example, a rivet head or lock washer securing the drive link 58 thereon. Still other connections securing the handle 12 and drive link 58 for pivoting together could also be used within the scope of the present invention, however. If desired, suitable stops (not shown) could be provided to limit the range of pivoting of the handle 12 relative to the housing 10.

A first connecting link 62 is suitably secured to the opposite end of the drive link 58 for relative pivoting about a second axis 64. A second connecting link 68 is suitably secured to the opposite end of the first connecting link 62 for relative pivoting about a third axis 70. Such pivotal connections can be provided by, for example, pivot pins 72, 74 with suitable heads on the ends of the pins 72, 74 securing the relatively pivotable links together. The first and second connecting links 62, 68 may also be referred to as a single connecting link having a spacing member (first connecting link 62) and a connecting member (second connecting link 68).

The other end of the second connecting link 68 includes a flange 76 substantially perpendicular to the second connecting link 68 including a narrow portion 78 with a first width adjacent the longitudinal portion of the link 68 which is pivotable within the circular portion 80 of an opening in the tie bar 32 (see FIG. 2). The flange 76 also includes a wide portion 82 with a second width spaced from the longitudinal portion of the link 68. Such a connection (as is shown in U.S. Pat. Nos. 4,991,886 and 5,118,145) allows for easy assembly and installation of the actuator 50 with the locking structure 22. Specifically, during assembly, the link 68 may be positioned substantially perpendicular to the tie bar 32 so that the flange wide portion 82 is aligned with the opening slot portion 84. Once the flange wide portion 82 is then passed through the tie bar opening, the link 68 may be pivoted down, with the flange narrow portion being guided within the opening circular portion 80 for pivotal motion of the link 68 relative to the tie bar 32. The flange wide portion 82, being wider than the opening circular portion 80, holds the link 86 to the tie bar 32 in operational positions of the link 86.

Figure 4:
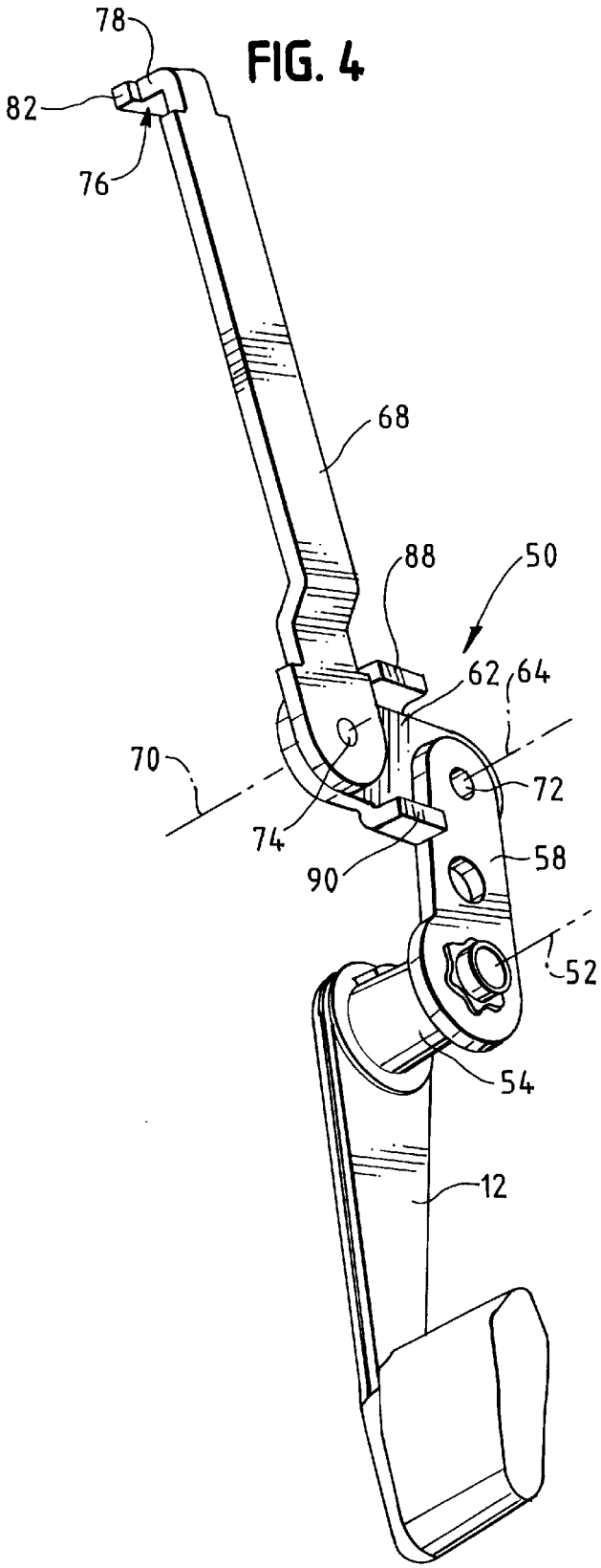
FIG. 4 is a perspective view of the handle actuator of the present invention.

As best seen in FIG. 4, the links 58, 62, 68 are, at their pivotal connections, all substantially flat, with the first connecting link 62 lying substantially in one plane and the drive link 58 and second connecting link 68 lying substantially in a second, parallel plane spaced from the plane of the first connecting link 62. As such, the links 58, 62, 68 are freely pivotable relative to one another between the limits provided by the stops having shoulders 88, 90 consisting of bent flanges on opposite sides of the first connecting link 62, which stop shoulders 88, 90 extend into the plane of the drive and second connecting link 58, 68 to engage the sides of those links 58, 68 at the pivot limits. While the stops 88, 90 illustrated can be easily and advantageously formed in the preferred embodiment of the present invention, it should be understood, however, that still other stops for limiting the relative pivoting of the links 58, 62, 68 could also be used within the scope of the present invention. For example, stop structures could be provided within the pivotal connection of the links, or similar flanges could be provided on the drive link 58 and second connecting link 68.

With this structure, stop shoulder 88 will essentially abut the second connecting link 68 in a right hand configuration such as shown in FIG. 2, thereby essentially forming a rigid L-shaped link such as is required in order to transmit the desired axial force to the tie bar 32. In a few positions, it will be recognized that the stop shoulders 88 or 90 may not engage the second connecting link 68, but instead will engage the drive link 58 to thereby transmit forces through what is essentially a rigid L-shaped link formed of the drive link 58 and first connecting link 62, at least until the handle 12 has pivoted sufficiently to position the actuator 50 so that the second connecting link 68 has pivoted to its limit relative to the first connecting link 62. In either case, however, the pivoting of the handle 12 will efficiently transmit force through the links 58, 62, 68 to control the longitudinal position of the connected tie bar 32 as desired for operation of the locking structure 22 so long as two of the three links 58, 62, 68 are held at their limits of relative pivoting to essentially form a rigid L-shaped link.

Figure 3:
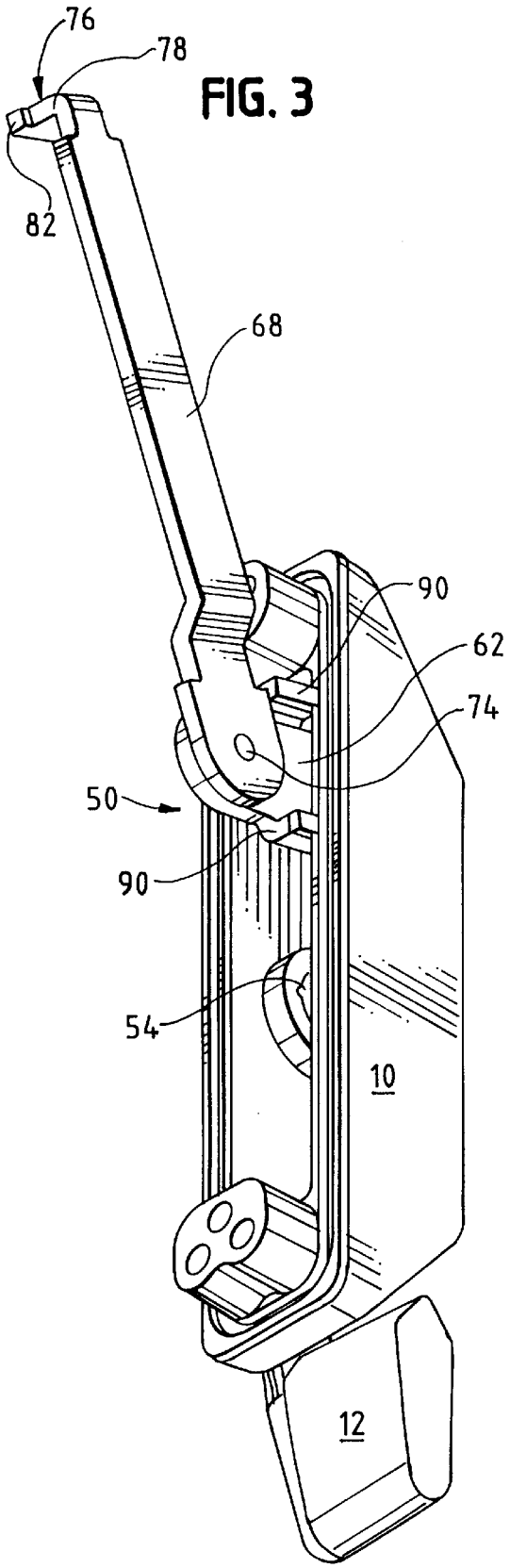
FIG. 3 is a perspective view of the handle actuator and housing of the present invention.

As illustrated in FIGS. 3 and 4, the stop shoulders 88, 90 are positioned at what is approximately one half of the transverse width of the adjacent drive and second connecting links 58, 68 from the pivot axes 64, 70. It will be appreciated that this configuration will provide for approximately 180 degrees of relative pivoting (between limit positions in which the links 58, 62 and 62, 68 are approximately at opposite right angles to one another). The combined relative pivoting of the second connecting link 68 about the third axis 70 and the first connecting link 62 about the second axis 64 in essence allows for approximately 360 degrees of relative pivoting between the second connecting member 68 and the drive link 58.

Such full relative pivoting allows the actuator 50 to be used in both right and left hand configurations. That is, converting an actuator 50 from one hand to the other essentially requires that the actuator 50 be turned upside down. For example, converting the actuator 50 of FIG. 3 to opposite hand operation would require that the housing 10 be flipped over. Further, such conversion would require that the handle 12 be pivoted relative to the housing 10 to its opposite position (i.e., with its knob end at what is the top of the housing 10 in FIG. 3 but would be at the bottom when flipped over). It should now be appreciated that when this conversion is done, the first connecting link 62 will pivot about 180 degrees relative to the drive link 58 (to ensure that it continues to project away from the inner side of the housing 10). Similarly, to provide a comparable position to that shown in FIG. 3, the second connecting link 68 would also pivot approximately 180 degrees relative to the first connecting link 62. In such an inverted, opposite hand position, the stop shoulder 90 will abut the second connecting link 68 at its limit position and the stop shoulder 88 will abut the drive link 58, thereby providing identical, but mirror image, operation as is necessary for opposite hand actuators 50.

In either position, it should be understood that counter-clockwise pivoting of the handle 12 (from the position shown in phantom in FIG. 2) causes the drive link 54 to carry the connecting links 62, 68 down with it, where the second connecting link 68 simultaneously pulls down on, and pivots relative to, the tie bar 32 (which is constrained for only axial movement by the tie bar guides 34). Such motion thus pulls the rollers 26, 28 off the keepers 38, 46 to unlock the window.

Conversely, in either position, clockwise rotation of the handle 12 (to the position shown in phantom in FIG. 2) causes the drive link 54 and connecting links 62, 68 to push the tie bar 32 up so that the rollers 26, 28 engage the keepers 38, 46, locking the window sash 16 to the window frame 14.

Further, this non-handed structure (with completely identical components) can be used with different window designs where the spacing from the tie bar 32 to the room facing frame surface differs significantly.

Still further, in a preferred embodiment of the present invention, the spacings between the first and second axes 52, 64 and between the second and third axes 64, 70 are both approximately ¾ to 1 inch, with the spacing from the third axis 70 to the flange 76 being about 3 inches. It has been found that these dimensions will provide the necessary range of operational motion without the second connecting link 68 being pivoted more than about 15 degrees from the longitudinal axis of the tie bar 32 in virtually all window designs. Such a close alignment of the longitudinal orientation of the connected tie bar 32 and second connecting link 68 ensures substantially all of the force applied by the actuator 50 will be in the desired direction (longitudinally along the tie bar 32) with only minimal side forces.

It should be also be understood that the range of motion provided by stop shoulders 88, 90 could be varied from that described above. For example, if the handle 12 is secured to the housing 10 so that its range of pivoting is X degrees (less than 180 degrees), then in the most preferred embodiment the stop shoulder 88, 90 would be provided so as to allow combined relative pivoting between the three links 58, 62, 68 of approximately 2X degrees. As a specific example, if the handle 12 were limited to a 140 degree range of pivoting, then a preferred configuration of the stop shoulder 88, 90 would be such as to limit the drive link 58 to a 280 degree range of pivoting relative second connecting link 68 (for example, by limiting the drive link 58 to a 140 degree range of pivoting relative to the first connecting link 62 and limit the second connecting link 68 to a 140 degree range of pivoting relative to the first connecting link 62). While this relationship would hold true for even smaller ranges of handle pivoting, generally it is preferred that the handle 12 have a pivot range of 140 degrees or higher to ensure recognizably proper operation by the person pivoting the handle 12.

It should also be understood that precision in the pivot limits such as described above is not required, and some play could be allowed in the operation of the actuator 50 by using stop shoulder 88, 90 which do not provide precisely the relative X:2X pivot limits discussed.

As a result of using this significantly improved structure, the previously known multi-point locking structure providing secure and reliable operation can be utilized in many different windows having window frames and window sashes with a variety of dimensions and configurations. Further, since different parts are not required for different window designs, widespread use of these locks may be accomplished with minimum expense and problems.

Specifically, the costs and problems which can arise are minimized during (1) manufacture (mass production of a single set of components is possible), (2) inventorying (many different components usable with every possible window design need not be separately inventoried by suppliers), (3) delivery (there is no risk of delay as the result of delivering a lock which is not usable with the particular window design), and (4) installation (the installer need not worry about different components and/or different installation techniques being required for different windows).

Still other aspects, objects, and advantages of the present invention can be obtained from a study of the specification, the drawings, and the appended claims.

We claim:

1. A non-handed actuator for window locks of the type in which a lock control member is moved by said actuator to control the locking of a window sash to a window frame, said actuator comprising:

a base securable to the window frame;

a handle secured to said base for pivoting about a first axis through an angle of approximately X degrees, said handle generally extending in a first radial direction from said first axis;

a connecting link securable to the lock control member of a window lock, said connecting link having a spacing member with a pivot defining a pivot axis fixed along its length and a connecting member, said spacing member not being directly connected to said base and said connecting member being securable to the lock control member and pivotable relative to said spacing member between limit positions approximately 180 degrees apart, a drive link secured for pivoting with said handle, said drive link generally extending in a second radial direction from said first axis, said first and second radial directions being on generally opposite sides of said first axis, said drive link being secured to said spacing member pivot for pivoting about said spacing member pivot axis for pivotal movement of said spacing member independent of said base.

2. A non-handed actuator for window locks of the type in which a lock control member is moved by said actuator to control the locking of a window sash to a window frame, said actuator comprising:

a base securable to the window frame;

a handle secured to said base for pivoting about a first axis through an angle of approximately X degrees, said handle generally extending in a first radial direction from said first axis;

a drive link secured for pivoting with said handle, said drive link generally extending in a second radial direction from said first axis, said first and second radial directions being on generally opposite sides of said first axis;

a connecting link securable to the lock control member of a window lock and pivotable relative to said drive link, said connecting link having a spacing member and a connecting member, said connecting member being securable to the lock control member and pivotable relative to said spacing member between limit positions approximately 180 degrees apart; and a first tab on one of said spacing member and connecting member and a second tab on one of said spacing member and connecting member, said first tab abutting one side of the other of said spacing member and said connecting member when said connecting member is at one of said limit positions and said second tab abutting the other side of the other of said spacing member and connecting member when said connecting member is at the other of said limit positions.

3. The actuator of claim 2, wherein said spacing member substantially lies in a first plane and said connecting member includes a portion lying in a second plane substantially parallel to and spaced from said first plane, and said tabs lie in both said first plane and said second plane.

4. A non-handed actuator for window locks of the type in which a lock control member is moved by said actuator to control the locking of a window sash to a window frame, said actuator comprising:

a base securable to the window frame;

a handle secured to said base for pivoting about a first axis through an angle of approximately X degrees, said handle generally extending in a first radial direction from said first axis;

a drive link secured for pivoting with said handle, said drive link generally extending in a second radial direction from said first axis, said first and second radial directions being on generally opposite sides of first axis;

a connecting link securable to the lock control member of a window lock and pivotable relative to said drink link, said connecting link not being directly connected to said base and having stops limiting the relative pivoting of the connecting link relative to the drive link so as to be independent of said base, said relative pivoting being limited to an angle of approximately 2X degrees.

5. A non-handed actuator for window locks of the type in which a lock control member is moved by said actuator to control the locking of a window sash to a window frame, said actuator comprising:

a base securable to the window frame;

a handle secured to said base for pivoting about a first axis through an angle of approximately X degrees, said handle generally extending in a first radial direction from said first axis;

a drive link secured for pivoting with said handle, said drive link generally extending in a second radial direction from said first axis, said first and second radial directions being on generally opposite sides of first axis;

a connecting link securable to the lock control member of a window lock and pivotable relative to said drink link, said connecting link comprising first and second connecting link members, said first connecting link member being pivotally connected to said drive link and said second connecting link member being pivotally connected to said first connecting link member; and stops limiting the relative pivoting of the connecting link relative to the drive link to an angle of approximately 2X degrees, said stops comprising tabs on opposite sides of said first connecting link member limiting pivoting of the drive link relative to the first connecting link member and of the first connecting link member relative to the second connecting link member, at least one tab abutting the drive link at each limit of relative pivoting of the drive link to the first connecting link member and at least one tab abutting the second connecting link member at each limit of relative pivoting of the first connecting link member to the second connecting link member.

6. The actuator of claim 5, wherein said first connecting link member substantially lies in a first plane normal to said first axis and said second connecting link member and drive link each include portions lying in a second plane substantially parallel to and spaced from said first plane, and said stops comprise tabs on said first connecting link member extending from said first plane to said second plane.

7. The actuator of claim 5, wherein the stops limit relative pivoting of the links whereby said second connecting link may pivot up to about 360 degrees relative to the drive link.

8. The actuator of claim 7, wherein X is between 140 and 180.

9. A non-handed actuator for window locks of the type in which a lock control member is moved by said actuator to control the locking of a window sash to a window frame, said actuator comprising:

a base securable to the window frame;

a handle secured to said base for pivoting about a first axis, said handle generally extending in a first radial direction from said first axis;

a drive link secured for pivoting with said handle, said drive link generally extending in a second radial direction from said first axis, said first and second radial directions being on generally opposite sides of said first axis;

a first connecting link having a pivot defining a second axis spaced from said first axis, said first connecting link pivot being secured to said drive link for pivoting about said a second axis, said second axis being fixed relative to and adjacent one end of said first connecting link;

a second connecting link secured to said first connecting link for pivoting about a third axis spaced from said second axis, said second connecting link being securable to the lock control member of a window lock; and stops limiting the pivoting of the drive link relative to the first connecting link and of the first connecting link relative to the second connecting link.

10. The actuator of claim 9, wherein said first connecting link substantially lies in a first plane normal to said second and third axes and said second connecting link and drive link each include portions lying in a second plane substantially parallel to and spaced from said first plane, and said stops comprise tabs on said first connecting link extending from said first plane to said second plane.

11. The actuator of claim 9, wherein the stops limit relative pivoting of the links whereby said second connecting link may pivot up to about 360 degrees relative to the drive link.

12. The actuator of claim 11, wherein the stops limit relative pivoting of the links whereby said second connecting link may pivot between opposite limit positions generally parallel to the drive link.

13. The actuator of claim 11, wherein the stops limit pivoting of the second connecting link relative to the drive link to an angle of 2X degrees, where X is between 140 and 180.

14. The actuator of claim 13, wherein the handle is pivotable through an angle of approximately X degrees relative to the base.

15. A non-handed actuator for window locks of the type in which a lock control member is moved by said actuator to control the locking of a window sash to a window frame, said actuator comprising:

a base securable to the window frame;

a handle secured to said base for pivoting about a first axis, said handle generally extending in a first radial direction from said first axis;

a drive link secured for pivoting with said handle, said drive link generally extending in a second radial direction from said first axis, said first and second radial directions being on generally opposite sides of said first axis;

a first connecting link secured to said drive link for pivoting about a second axis spaced from said first axis;

a second connecting link secured to said first connecting link for pivoting about a third axis spaced from said second axis, said second connecting link being securable to the lock control member of a window lock; and stops limiting the pivoting of the drive link relative to the first connecting link and of the first connecting link relative to the second connecting link, wherein said stops comprise tabs on opposite sides of said first connecting link, at least one tab abutting the drive link at each limit of relative pivoting of the drive link to the first connecting link and at least one tab abutting the second connecting link at each limit of relative pivoting of the first connecting link to the second connecting link.

16. The actuator of claim 15, wherein said drive link and first and second connecting links extend longitudinally in a generally radial direction relative to the pivot axes with a transverse width, one of said stops being longitudinally spaced from the second axis generally one half of the drive link transverse width.

17. The actuator of claim 15, wherein said drive link and first and second connecting links extend longitudinally in a generally radial direction relative to the pivot axes with a transverse width, and said stops are longitudinally spaced from the second axis generally one half of the drive link transverse width and longitudinally spaced from the third axis generally one half of the second connecting link transverse width.

18. A non-handed actuator for window locks of the type in which a lock control member is moved linearly by said actuator to control the locking of a window sash to a window frame, said actuator comprising:

a housing securable to the window frame with an interior side facing toward the window frame;

a handle secured to said housing for pivoting about a first axis, said handle generally extending in a first radial direction from said first axis;

a generally flat drive link secured for pivoting with said handle, said drive link generally on the housing interior side and extending in a second radial direction from said first axis, said first and second radial directions being on generally opposite sides of said first axis;

a generally flat first connecting link secured to said drive link for pivoting about a second axis spaced from said first axis;

a generally flat second connecting link secured to said first connecting link for pivoting about a third axis spaced from said second axis, said second connecting link being securable to the actuating member of a window lock;

first stop shoulders extending axially from the first connecting link and engaging said drive link at a selected limit of pivoting of said drive link relative to the first connecting link; and second stop shoulders extending axially from the first connecting link and engaging said second connecting link at a selected limit of pivoting of said second connecting link relative to the first connecting link.

19. The actuator of claim 18, wherein said first and second stop tabs are unitary shoulders formed from flanges on opposite sides of said first connecting link and bent at generally right angles to the flat first connecting link.

20. The actuator of claim 18, wherein said first connecting link substantially lies in a first plane normal to said second and third axes and said second connecting link and drive link each include portions lying in a second plane substantially parallel to and spaced from said first plane, and said stop shoulders extend from said first plane to said second plane.

21. The actuator of claim 18, wherein said drive link and first and second connecting links extend longitudinally in a generally radial direction relative to the pivot axes with a transverse width, one of said stop shoulders being longitudinally spaced from the second axis generally one half of the drive link transverse width.

22. The actuator of claim 18, wherein said drive link and first and second connecting links extend longitudinally in a generally radial direction relative to the pivot axes with a transverse width, and said stop shoulders are longitudinally spaced from the second axis generally one half of the drive link transverse width and longitudinally spaced from the third axis generally one half of the second connecting link transverse width.

* * * * *